United States Patent [19]

Ling

[11] Patent Number: 5,027,623

[45] Date of Patent: Jul. 2, 1991

[54] COMBINATION LOCK HAVING SENSING MEANS FOR DIALING AID AND ANTI-SENSING MEANS FOR SECURITY PURPOSE

[76] Inventor: Chong-Kuan Ling, c/o Sinox Co. Ltd., P.O. Box 53-58, Taipei, Taiwan

[21] Appl. No.: 597,566

[22] Filed: Oct. 15, 1990

[51] Int. Cl.[5] ..... E05B 37/02

[52] U.S. Cl. ..... 70/26; 70/312; 70/318; 70/328; 70/DIG. 44

[58] Field of Search ..... 70/312, 315-318, 70/327, 328, 332, 26, DIG. 44

[56] References Cited

U.S. PATENT DOCUMENTS

| | | | |
|---|---|---|---|
| 4,383,425 | 5/1983 | Orabona | 70/312 |
| 4,441,346 | 4/1984 | Castiglioni | 70/312 |
| 4,445,348 | 5/1984 | Saitoh | 70/312 |
| 4,610,152 | 9/1986 | Düringer | 70/312 X |

FOREIGN PATENT DOCUMENTS

| | | | |
|---|---|---|---|
| 464850 | 8/1928 | Fed. Rep. of Germany | 70/312 |
| 656879 | 5/1929 | France | 70/317 |
| 830889 | 5/1938 | France | 70/312 |
| 629119 | 9/1949 | United Kingdom | 70/312 |

*Primary Examiner*—Lloyd A. Gall

[57] ABSTRACT

A combination lock includes a lock body, having a hollow spindle laterally protruding outwardly, a locking bolt having a plurality of projections formed on the bolt insertably into the hollow spindle adapted for locking the lock, a plurality of dials normally coupled with sleeves rotatably mounted in the lock body having a plurality of annular corrugated teeth formed on an inner ring of each sleeve retarding the withdrawal of the projections of the bolt to prevent a trial opening by touch feeling by an intruder when rotating the dials in order to find out an opening slot formed in the sleeves for withdrawing the locking bolt, a plurality of positioner plates slidably held on the spindle for rotatably clickingly engageable with the sleeves for helping sensing a subsequent dialing operation from numeral to numeral; and a combination-changing plate pre-inserted in the locking bolt for pushing the sleeves inwardly to disengage their coupling with the dials for free rotation of dials for re-setting a new combination.

12 Claims, 5 Drawing Sheets

COMBINATION LOCK HAVING SENSING MEANS FOR DIALING AID AND ANTI-SENSING MEANS FOR SECURITY PURPOSE

BACKGROUND OF THE INVENTION

Saitoh disclosed a combination lock in his U.S. Pat. No. 4,445,348 which is capable of being set in any desired combination of numbers or changed from the once set specific combination to any other combination without using any tool. However, when changing the combination to a new one, the outermost dial ring should be first dismounted from the corresponding inner ring and the other dial rings should then be disengaged. After re-setting a new combination, the dial rings should be fitted on the inner rings one by one, causing a very inconvenient operation for changing a new combination.

Mayer et al disclosed a permutation lock in their U.S. Pat. No. 4,354,365. For changing a new combination, the closing bolt 18 should be retracted outwardly to retard an inwardly radial movement of the shank 31 of locking pin 28 so that the inner rings 36 are secured against rotation for re-setting a new combination. However, the retraction of the bolt 18 should be done very carefully. Otherwise, if the recess 32 between every two lands 76 of the bolt 18 is meeting the shank 31, the pin 28 will not be retarded radially outwardly, allowing a coupled rotation of the two rings 36, 38 thereby influencing the operation for changing the combination.

Meanwhile, Mayer's pin head 30 of each locking pin 28 resiliently urges two neighbouring rings commonly for safety purpose. If only one ring (rather than two rings) partially depresses the pin head 30 to lower the pin 28 to be engageable with the recess 32 for locking the bolt 18, the locking pin 28 may be inclinedly biased downwardly deviating from a vertical axis of the pin 28, thereby influencing a smooth downward sliding movement of the pin or increasing a difficult locking operation therefor.

The present inventor has found the drawbacks of the conventional combination locks and invented the present combination lock.

SUMMARY OF THE INVENTION

The object of the present invention is to provide a combination lock having a simply-constructed plate for changing combination.

Another object of the present invention is to provide a combination lock having a plurality of sensing positioner plates respectively rotatably clickingly engageable with a plurality of sleeves coupled with dial, whereby upon a rotation of the dials for opening the combination lock, the subsequent dialing of the combination numbers can be feelingly secured, helpful for a lock user himself or herself especially at night time.

Still another object of the present invention is to provide a combination lock having annular corrugated teeth formed in an inner ring of each sleeve coupled with the dial for preventing an unexpected opening of the lock as tried by an intruder by his or her touch feeling.

DETAILED DESCRIPTION

Figure 1:
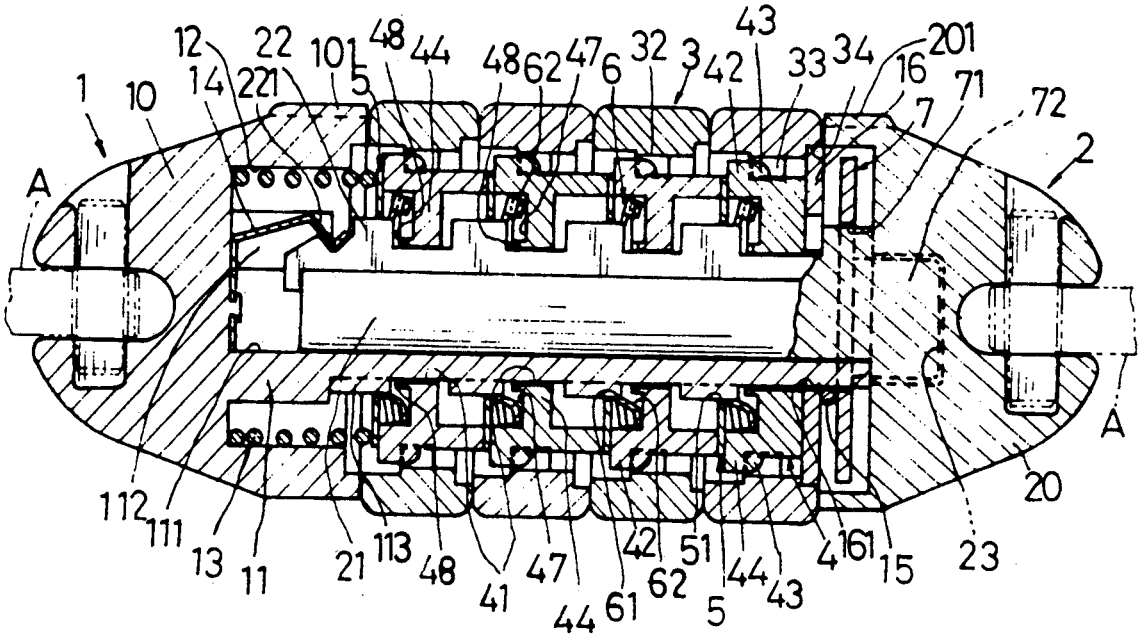
FIG. 1 is a sectional drawing showing an assembled combination lock of the present invention when locked.
Figure 2:
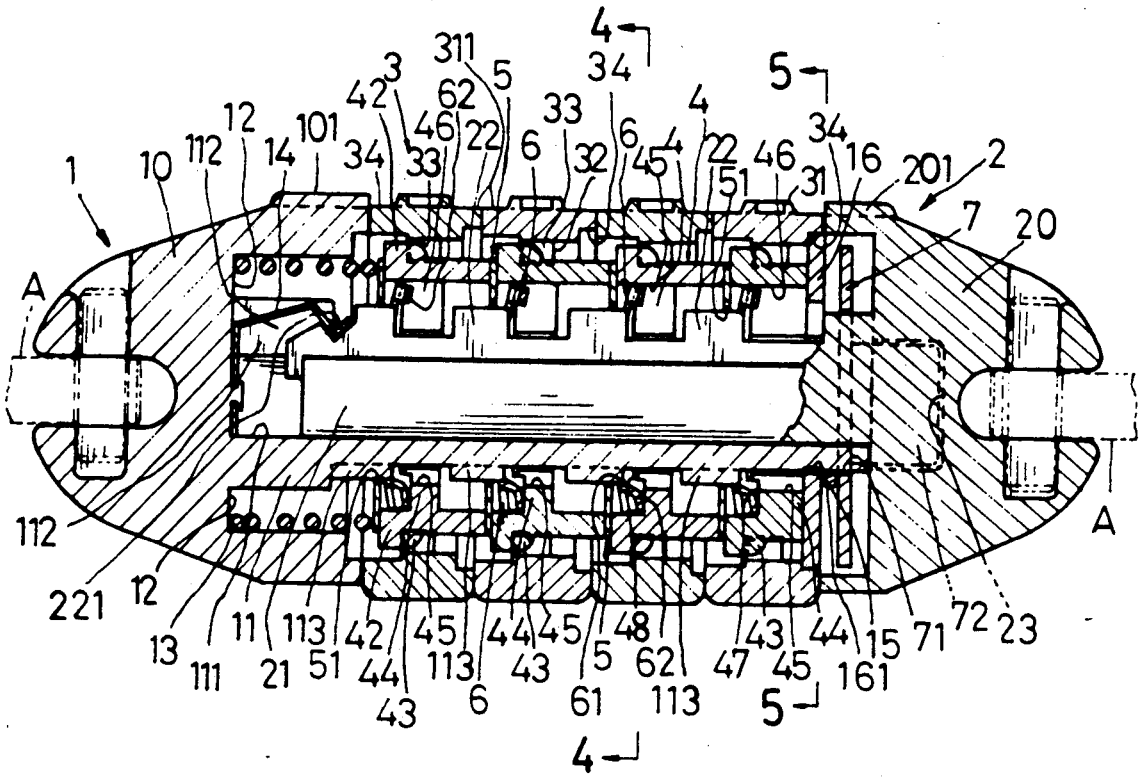
FIG. 2 shows an opened lock of the present invention.
Figure 3:
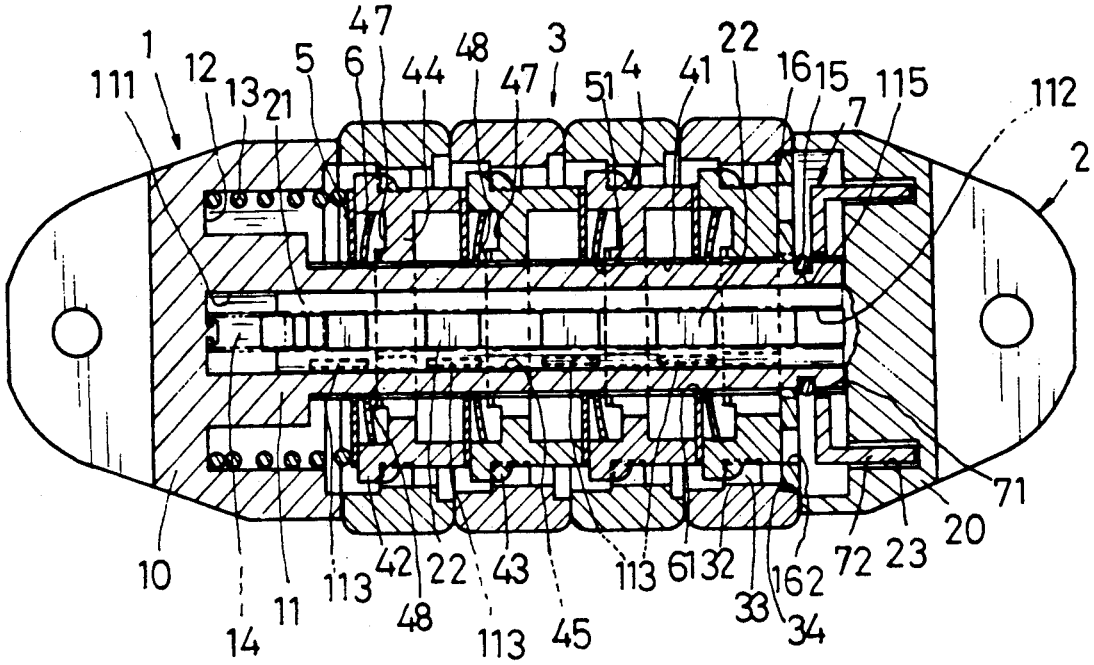
FIG. 3 is a top view of FIG. 2 of the present invention.

As shown in FIGS. 1–8, the present invention comprises: a lock body 1 secured with one end of a wire A used for fastening or locking articles (not shown), a locking bolt 2 secured with the other end of the wire A insertable into the lock body 1 for locking the wire A, a plurality of dials 3 rotatably mounted in the lock body 1, a plurality of sleeves 4 respectively engageable with the plurality of dials 3, a plurality of spacers 5 respectively partitioning the sleeves 4, a plurality of sensing positioner plates 6 each rotatably clickingly engageable with each sleeve 4 for operatively sensing a subsequent dialing operation in every numeral of the combination (numbers), and a combination-changing plate 7 operatively re-setting a new combination.

The lock body 1 includes: a hollow spindle 11 longitudinally protruding outwardly from a lock base 10, a spring socket 12 formed in the lock base 10 for retaining a tensioning spring 13 therein, a spring catch 14 secured in the socket 12, a retainer ring 15 embedded in a ring groove 115 formed in an outer end portion of the hollow spindle 11 for retaining a positioning retainer 16 thereon for limiting the dials 3 rotatably mounted on the spindle 11.

The locking bolt 2 includes: a bolt base 20, a longitudinal bolt 21 protruding inwardly towards the lock base 10 from the bolt base 20 slidably engageable with a central bolt hole 111 formed in the hollow spindle 11, a plurality of projections 22 longitudinally formed and equally spaced on the bolt 21 slidably engageable with a longitudinal notch 112 formed in the spindle 11, a tip recess 221 formed in an innermost end portion of the bolt 21 engageably retained by the spring catch 14 held in the socket 12 for preventing an unexpected withdrawal of the bolt 21 when opening a lock of the present invention, and an opening indicating extension 201 formed on the bolt base 20 projectively corresponding to another opening indicating extension 101 formed on the lock base 10.

The hollow spindle 11 is longitudinally formed with a plurality of extensions 113 protruding radially outwardly from a cylindrical surface of the spindle 11, and positioning grooves 114 radially recessed inwardly from the cylindrical surface of the spindle 11.

The positioning retainer 16 is formed with a central hole 161 corresponding to the grooves 114 and the projections 22 so that the retainer 16 can be mounted on the spindle 11. Two key holes 162 are formed in two side portions of the retainer 16.

Each dial 3 generally formed as a cylindrical collar includes: a plurality of numerals 31 (for instance, 0, 1, 2, . . . 9) circumferentially formed on an outer cylindrical surface, an inner ring 32 formed inside the dial 3 having a plurality of recesses annularly formed in the ring 32, and an annular groove 34 formed in the dial 3 for engaging the positioning retainer 16 for limiting the dials 3 on the spindle 11.

Each recess 33 is corresponding to each numeral 31 formed on the outer surface. Each zero numeral (0) may be formed as circular extension protruding upwardly from a numeral base 311 which is downwardly recessed from the outer cylindrical surface of the ring 3 for a remarkable touch feeling for initiating dialing of the dial number. The circular extension of numeral "zero" is coplanar to a cylindrical surface of the remaining numerals 31 disposed on the dial 3.

Each sleeve 4 includes a central hole 41 rotatably engageable with an outer cylindrical surface of the hollow spindle 11, a flange 42 rotatably held in the dial 3 having a plurality of protrusions 43 formed on an outer cylindrical surface of the sleeve 4 adjacent to the flange 42 to be engageable with the recesses 33 formed in the inner ring 32 of dial 3, an inner ring 44 circumferentially formed on a central portion of an inner cylindrical surface inside the sleeve 4 defining the central hole 41, a combination-changing slot 45 and an opening slot 46 formed through the inner ring 44 respectively corresponding to each extension 113 formed on the spindle 11 and the longitudinal slot 112 of the spindle 11 for slidably moving the projections 22, a plurality of dial-sensing recesses 47 annularly formed in the inner ring 44 each recess 47 rotatably projectively corresponding to each numeral 31 formed on the dial 3, and a plurality of annular corrugated teeth 48 annularly formed on the inner ring 44. Each projection 22 and each extension 113 is normally rotatably held within a cavity defined between two inner rings 44 of two neighbouring sleeves 4.

The tensioning spring 13 normally urges the spacers 5 and the sleeves 4 rightwardly as shown in FIG. 1 to allow the protrusions 43 to be engageably retained on the recesses 33 of the dial 3. All sleeves 4 are limited by the positioning retainer 16.

Each spacer 5 is formed with a central guide hole 51 slidably engageable with the spindle 21, the projections 22 of spindle 21, the extension 113 and positioning grooves 114 formed on spindle 21. The spacers 5 are provided for partitioning every two neighbouring sleeves 4, in which an innermost spacer 5 is resiliently retained by spring 13.

Each sensing positioner plate 6 has a cross section generally arcuate shaped with its annular periphery slightly bent outwardly towards the bolt base 20, and includes a central guide hole 61 slidably engageable with the spindle 21, the projections 22 of spindle 21, the extension 113 and grooves 114 formed on spindle 11. Each plate 6 is inserted in between each sleeve 4 and each spacer 5. A plurality of sensing protrusions 62 are annularly formed on a periphery of the plate 6 each protrusion 62 resiliently engageable with each dial-sensing recess 47 corresponding to each numeral 31 formed on dial 3 as urged by spring 13 and spacer 5.

The combination-changing plate 7 includes a central hole 71 slidably engageable with the spindle 21 and projections 22 of spindle 21, two extending keys 72 formed on two opposite sides of the plate 7 normally embedded in two key holes 23 formed in the bolt base 20 and operatively poking through two slots 162 formed in two side portions of the retainer 16 for pushing the sleeves 4 inwardly for changing combination purpose.

When using the present invention for opening a lock, the dials 3 coupled with sleeves 4 are rotated with respect to the opening indicating extension 101, 201 formed on the lock base 10 and bolt base 20 to an opening combination to allow the opening slot 46 of each sleeve 4 to match with the projections 22 of the spindle 21 so that the locking bolt 2 can be withdrawn from the lock body 1 for opening the lock.

For rotating the dials 3, the user may touch each dial from the zero numeral 31 having circular extension of "0" shape by feeling, and then rotate the dial 3 and sleeve 4 by subsequently rotatably clicking the protrusion 62 on each sensing recess 47 formed on sleeve 4 to judge the dialing from one arabic number to next arabic number, thereby opening the lock by sense of feeling even at night without any illumination by a lock user or owner.

For locking the lock of the present invention, the dials and the sleeves are optionally rotated to confuse the opening combination to disengage the opening slot 46 of each sleeve 4 from the projection 22 of the bolt 2 so that the projections 22 are retarded by the teeth 48 of each inner ring 44 of each sleeve 4 to prevent a withdrawal of the bolt from the lock body, thereby locking the lock.

Figure 6:
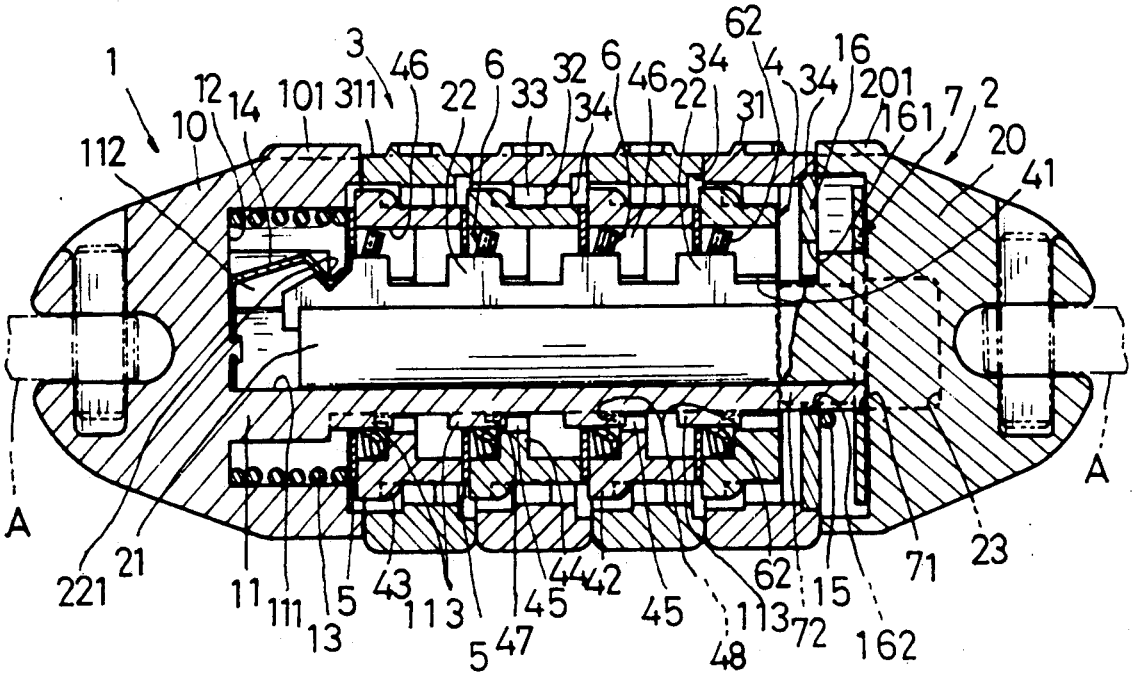
FIG. 6 is a sectional illustration showing the changing of combination of the present invention.
Figure 4:
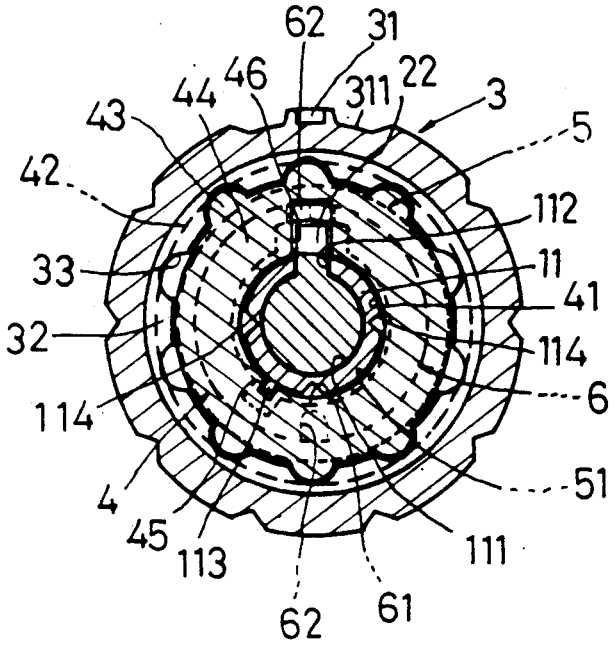
FIG. 4 is a cross-sectional drawing of the present invention when viewed from 5—5 direction of FIG. 2.
Figure 5:
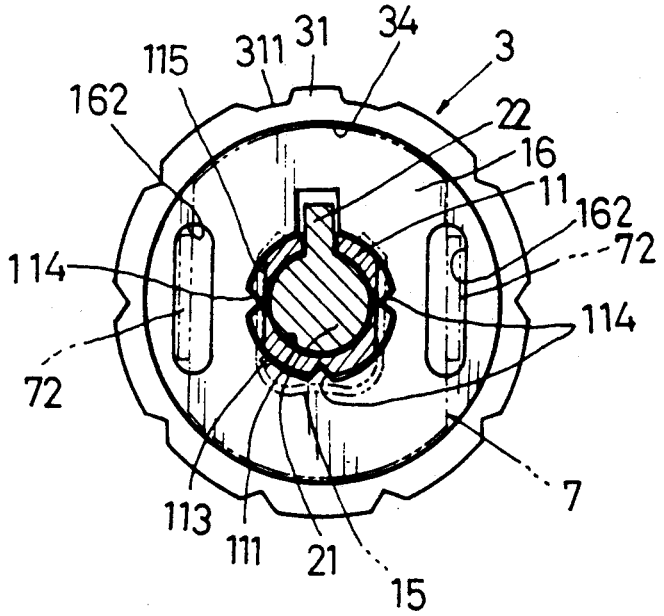
FIG. 5 is a sectional drawing of the present invention when viewed from 4—4 direction of FIG. 2.
Figure 7:
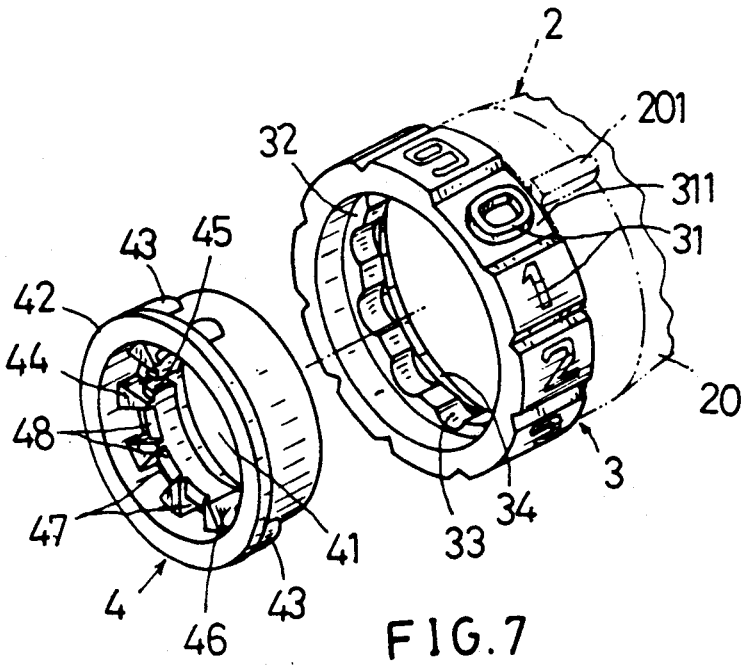
FIG. 7 shows a sleeve and a dial of the present invention.

When it is intended to change or reset a new opening combination, the two extending keys 72 of the combination-changing plate 7 are pulled from the key holes 23 of the bolt base 20 when the bolt 21 is withdrawn from the lock body 1, and are then inverted their direction to poke the two keys 72 through the slots 162 in retainer 16 to push the sleeves 4 inwardly by reinserting the bolt 21 into the lock body 1 as shown in FIG. 6 to engage the slot 45 of each sleeve 4 with each extension 113, to firmly hold each sleeve 4 without being rotated about an axis of the hollow spindle 11, whereby upon a rotation of dials 3, a new combination can be set up. The keys 72 may then be returned to the holes in the bolt base 20. The sleeves 4 are also restored by spring 13 ready for locking purpose.

Figure 9:
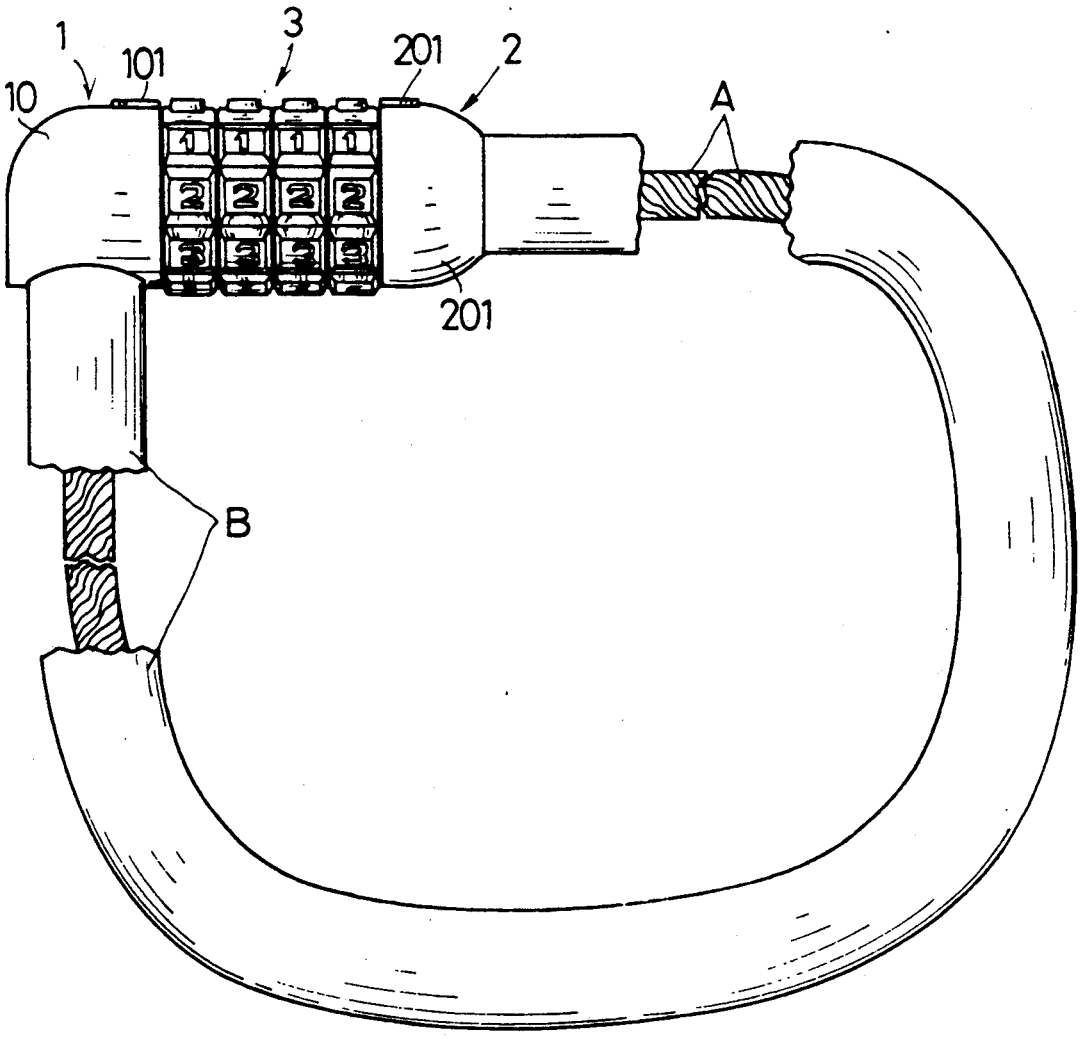
FIG. 9 shows another preferred embodiment of the present invention.
Figure 8:
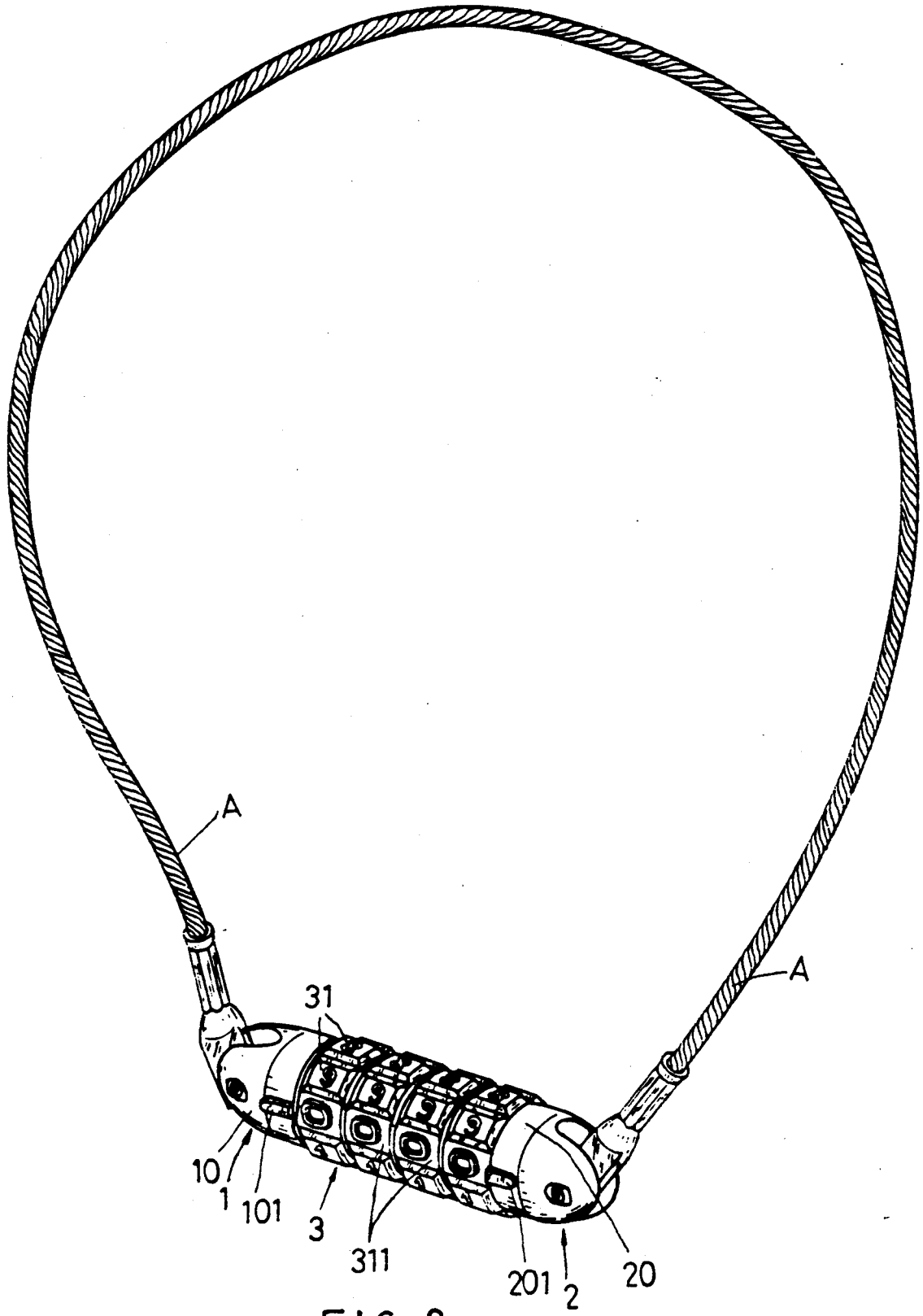
FIG. 8 is a perspective view of the present invention.

As shown in FIG. 9, the wire or cable A respectively secured to the lock body 1 and locking bolt 2 may be sheathed by a plastic covering B and two end portions of the wire A may be made to be perpendicular to each other.

The present invention has the following advantages superior to a conventional combination lock:

1. For opening the lock by a lock user or owner himself or herself, the sensing positioner plate 6 and the sensing recess 47 in each sleeve 4 may cause a convenient opening operation by feeling, especially at night time and helpful for a blindman.

2. For a trial opening by an intruder or a thief, each projection 22 of the locking bolt 21 may be rotatably retarded by the corrugated teeth 48 formed on sleeve ring 44, thereby confusing the finding-out of the opening slot 46 of the sleeve 4 which may be misled as a "recessed tooth portion" among the annular corrugated teeth 48 and therefore enhancing the security lock effect of this invention.

3. For opening a new combination, there is no need to dismantle the dials and sleeves. A new combination can be easily obtained just by pull and push operation of the keys 72 as aforementioned.

I claim:

1. A combination lock comprising:

a lock body having a hollow spindle longitudinally protruding outwardly from a lock base of said lock body and a tensioning spring held in a spring socket formed in said lock base;

a locking bolt having a longitudinal bolt protruding inwardly towards said lock base from a bolt base of said locking bolt slidably engageable with a central bolt hole formed in said hollow spindle, and a plurality of projections longitudinally formed and equally spaced on said longitudinal bolt slidably engageable with a longitudinal notch formed in said spindle;

a plurality of dials rotatably mounted on said lock body each said dial having a plurality of numerals circumferentially formed on an outer cylindrical surface of the dial, and an inner ring formed inside the dial having a plurality of recesses annularly formed in the inner ring of the dial;

a plurality of sleeves rotatably mounted on said hollow spindle each said sleeve having a plurality of protrusions formed on an outer cylindrical surface of said sleeve engageable with said recesses formed in said inner ring of said dial, an opening slot formed through an inner ring of said sleeve for operatively slidably engageable with said projections of said bolt for opening said lock, a plurality of dial-sensing recesses annularly formed in the inner ring of said sleeve rotatably projectively corresponding to each said numeral formed on said dial, and a plurality of annular corrugated teeth annularly formed on the inner ring of said sleeve normally retarding said projections for locking said bolt;

a plurality of spacers slidably held on said spindle for partitioning every two neighbouring said sleeves, of which one inner spacer is urged by said tensioning spring to resiliently urge said sleeves to be engageable with said dials;

a plurality of sensing positioner plates slidably held on said spindle each said positioner plate inserted between each said sleeve and each said spacer having a plurality of sensing protrusions annularly formed on said positioner plate resiliently clickingly engageable with each said dial-sensing recess corresponding to each said numeral of said dial; and a combination-changing plate having two extending keys formed on two opposite side portions thereof normally embedded in two key holes formed in said bolt base, and operatively inverted to push said sleeves inwardly to be disengaged from said dials for freely rotating said dials for resetting a new combination;

whereby upon a rotation of said dial and said sleeve, each said sensing protrusion of said sensing positioner plate will be rotatably clickingly engageable with each said dial-sensing recess of said sleeve for subsequently sensing the dialing operation from each numeral to the next numeral by feeling; and upon a trial opening by a thief by rotating the dials, the sleeves and withdrawing the bolt, each said projection of said locking bolt will be rotatably retarded by the corrugated teeth annularly formed in said sleeve, thereby confusing the opening trial by sense of feeling.

2. A combination lock according to claim 1, wherein said combination-changing plate includes a central hole slidably engageable with said spindle, having said two extending keys normally embedded in two key holes formed in said bolt base, and operatively poking through two slots formed in a positioning retainer formed on an outer end portion of said spindle for pushing said sleeves inwardly for changing combination.

3. A combination lock according to claim 1, wherein each said sleeve is formed with a combination-changing slot in said inner ring of said sleeve slidably engageable with an extension formed in said spindle, so that upon an inward pushing of said sleeves to engage said combination-changing slot with said extension on said spindle, said sleeve will be held without being rotated about an axis of said hollow spindle for a free rotation of the dials for setting a new combination.

4. A combination lock according to claim 1, wherein each said sensing positioner plate has a cross section generally arcuate shaped with its annular periphery slightly bent outwardly towards said bolt base for resiliently engaging each said sleeve.

5. A combination lock according to claim 1, wherein said locking bolt includes a tip recess formed in an innermost end portion of said bolt engageably retained by a spring catch held in an inner portion of said lock body, preventing a withdrawal of said bolt when opening a lock.

6. A combination lock according to claim 1, wherein each said sleeve includes a combination-changing slot formed in said inner ring of said sleeve for slidably engaging an extension formed on said spindle, when pushed inwardly by said keys of said combination-changing plate.

7. A combination lock according to claim 1, wherein each said dial includes a zero numeral formed with a circular extension of "0" shape protruding upwardly from a numeral base which is downwardly recessed from the outer cylindrical surface of said dial, said circular extension of numeral zero being coplanar to the cylindrical surface of the remaining numerals disposed on said dial.

8. A combination lock according to claim 2, wherein said positioning retainer for limiting said sleeves is engaged in an annular groove formed in an outer portion of one said dial mounted on an outermost end of said spindle.

9. A combination lock according to claim 1, wherein said inner ring of each said sleeve is generally formed on a central portion of an inner cylindrical surface inside said sleeve, so that two said inner rings of two neighbouring sleeves will define a cavity for normally rotating said sleeve and said dial about said axis of said spindle without being retarded by said projections of said spindle.

10. A combination lock according to claim 1, wherein said inner ring of each said sleeve defines a central hole for rotatably engaging said spindle.

11. A combination lock according to claim 1, wherein said hollow spindle is formed with a plurality of positioning grooves radially recessed inwardly from an outer cylindrical surface of said spindle, slidably engageable with each central hole respectively formed in each said spacer and said positioner plate.

12. A combination lock according to claim 1, wherein said combination-changing plate includes a central hole engageable with said hollow spindle.

* * * * *